US008281431B2

(12) United States Patent
Hartenstine

(10) Patent No.: US 8,281,431 B2
(45) Date of Patent: Oct. 9, 2012

(54) PLAY YARD WITH CENTERLINE-MOUNTED OVAL CHANGING TABLE

(75) Inventor: Curtis M. Hartenstine, Birdsboro, PA (US)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 12/254,977

(22) Filed: Oct. 21, 2008

(65) Prior Publication Data

US 2009/0113622 A1 May 7, 2009

Related U.S. Application Data

(60) Provisional application No. 61/001,428, filed on Nov. 1, 2007.

(51) Int. Cl.
*A47D 5/00* (2006.01)

(52) U.S. Cl. ..... 5/93.1; 5/98.1; 5/99.1

(58) Field of Classification Search ..... 5/655, 93.1, 5/98.1, 99.1, 507.1, 503.1, 658
See application file for complete search history.

(56) References Cited

U.S. PATENT DOCUMENTS

| | | | | |
|---|---|---|---|---|
| 4,967,432 | A * | 11/1990 | Kujawski et al. | 5/98.1 |
| 5,553,336 | A | 9/1996 | Mariol | 5/93.1 |
| 5,957,436 | A * | 9/1999 | Ristau | 256/25 |
| 6,240,856 | B1 * | 6/2001 | Paskey et al. | 108/146 |
| 6,948,197 | B1 | 9/2005 | Chen | 5/93.1 |
| 2002/0166169 | A1 | 11/2002 | Longenecker | 5/93.1 |
| 2004/0133977 | A1 * | 7/2004 | Rimbau Vidal | 5/98.3 |
| 2005/0150053 | A1 * | 7/2005 | Hartenstine | 5/655 |
| 2006/0080776 | A1 * | 4/2006 | Clapper et al. | 5/93.1 |
| 2006/0130237 | A1 * | 6/2006 | Clapper et al. | 5/655 |
| 2009/0113624 | A1 * | 5/2009 | Tuckey | 5/93.1 |

* cited by examiner

*Primary Examiner* — William Kelleher
(74) *Attorney, Agent, or Firm* — Miller Law Group, PLLC

(57) ABSTRACT

A changing table is mounted on the vertical frame members of a play yard by mounting members located along the transverse centerline of the changing table. The frame of the changing table is formed in an oval shape to eliminate any portion thereof that would be oriented generally parallel to the upper frame members of the play yard. The vertical frame member is formed with a linear upper portion and a curved lower portion. The linear upper portions enable the mounting members to be telescopically received for height adjustment of the changing table. The curved lower portions positions the foot members at the lower ends of the vertical frame members outboard of the upper ends on which the changing table is mounted to enhance stability.

15 Claims, 5 Drawing Sheets

PLAY YARD WITH CENTERLINE-MOUNTED OVAL CHANGING TABLE

CROSS-REFERENCE TO RELATED APPLICATIONS

This application claims priority on U.S. Provisional Patent Application Ser. No. 61/001,428, filed on Nov. 1, 2007, and entitled "Height Adjustable Changing Table for Play Yard", the contents of which are incorporated herein by reference.

FIELD OF THE INVENTION

The present invention relates generally to a child's play yard enclosure and, more particularly, to a play yard having an oval changing table mounted on one end thereof along the centerline of the changing table.

BACKGROUND OF THE INVENTION

Play yards are used to contain and provide a safe environment for a child for sleeping or playing. Typically, play yards are collapsible so they can be stored or transported easily. Currently, play yards are manufactured with a frame that consists of a combination of assembled metal and plastic components with a fabric body that wraps around the frame to provide an enclosure to retain the child within the play yard. Play yards can be equipped with a bassinet assembly that can be supported by the play yard frame to establish an enclosed sleep area at a higher level than the bottom floor surface of the play yard to provide an easy access to the child without requiring the caregiver to bend to access the floor of the play yard.

Play yards are often provided with an elevated changing table on which an infant can be placed to position the infant at an elevated position for the convenience of the caregiver changing the infant's clothes. Changing tables include a frame that is supported on the frame of the play yard. Typically, the height of commercially available changing tables is fixed relative to the frame of the play yard so that the movement of the changing table frame will not create a head entrapment situation as defined by ASTM F 406-08 5-16. This is an ASTM standard that requires openings between frame members of structures holding children to be sufficiently large as to allow the passage of a large probe sized to replicate the $97^{th}$ percentile dimension of a 3 year olds back of head to tip of chin dimension, or to be smaller than a small probe sized to represent the dimensions of a $5^{th}$ percentile, six month old child's head.

Complying with such an ASTM standard limits the movement of the changing table as the frame of the changing table and the frame of the play yard must remain, at all positions of movement, at relative positions to either permit passage of the ASTM large probe or prevent passage of the ASTM small probe. Accordingly, conventional changing tables will have the range of movement such that the frame of the changing table will not be far enough above the frame of the play yard to allow the ASTM small probe to pass between the two frame members. Alternatively, the changing table will remain sufficiently far above the frame of the play yard that the ASTM large probe will always be able to pass between the two frame members. In the first instance, the range of movement is limited to only a few inches. In the second instance, the changing table will be positioned too high to provide a convenient and efficient usage.

Furthermore, conventional changing tables are formed with a base member that is mounted on the play yard frame and includes a table member, including a table frame, that is mounted to the side of the base member so that the center of gravity of the changing table with an infant disposed thereon will be aligned inside the play yard frame for purposes of stability of the play yard and the changing table. This offset mounting of the changing table places the table frame proximate to the frame of the play yard where the ASTM standards will apply to limit the range of height adjustment permitted to the changing table.

A bassinet is disclosed in U.S. Pat. No. 5,553,336, issued to John Mariol on Sep. 10, 1996, as being mountable onto the frame of a play yard with legs of the bassinet being received within the legs of the play yard. The Mariol bassinet is sufficiently large as to cover the entire upper portion of the play yard such that the bassinet and the play yard would not be simultaneously usable. Furthermore, the Mariol bassinet is not height adjustable with respect to the frame of the play yard.

U.S. Patent Publication No. 2002/0166169 of Michael Longenecker, et al published on Nov. 14, 2002, discloses a changing table for a play yard in which the changing table is pivotable about a transversely extending horizontal axis to be movable between an operating position and a storage position. Since the Longenecker changing table is not height adjustable, the base frame of the changing table and the play yard are fixed relative to one another. Similarly, a pivotable changing table mounted on the frame of a play yard is disclosed in U.S. Patent Publication No. 2006/0130237 of Johsua Clapper, et al published on Jun. 23, 2006. Like the Longenecker changing table, the Clapper changing table is fixed relative to the frame of the play yard and is pivotable about a transversely extending, horizontal pivot axis to permit the changing table to move between an operative position and a storage position.

A height adjustable changing table mounted on the frame of a play yard is shown in U.S. Patent Publication No. 2005/0150053 of Curtis M. Hartenstine published on Jul. 14, 2005, in which the changing table is movable through a range of positions through a rack and pinion mechanism with the lowermost position of the changing table being well above the frame of the play yard. The changing table is also pivotable about a transversely extending, horizontal pivot axis to move between an operative orientation and a storage orientation.

Accordingly, it would be desirable to provide a play yard/changing table structure that will provide a large range of vertical height adjustment without violating the ASTM standards relating to the passage of ASTM probes between frame members.

SUMMARY OF THE INVENTION

It is an object of this invention to provide a changing table structure for mounting on the frame of a play yard to provide an effective and conveniently usable station to place an infant child in order to change the infant's clothes.

It is another object of this invention to provide a changing table that can be mounted on the frame of a play yard to be vertically adjustable through a range of operative heights relative to the play yard frame.

It is a feature of this invention that the frame of the changing table is configured to eliminate any gap between the frame of the changing table and the frame of the play yard that can trap a child's head.

It is another feature of this invention that the frame of the changing table is configured in an oval shape.

It is an advantage of this invention that the oval shape of the changing table frame eliminates any structure of the changing table frame that is oriented generally parallel to the upper frame members of the play yard.

It is another advantage of this invention that the oval frame of the changing table diverges forwardly and inwardly relative to the upper side frame members of the play yard.

It is yet another feature of this invention that the changing table is mounted on the frame by mounting members located along a transversely extending centerline of the changing table.

It is another object of this invention to provide a play yard frame configuration that will maintain the center of gravity of the changing table inside of the lower play yard frame structure.

It is a further feature of this invention that the vertical frame members of the play yard frame structure beneath the changing table are formed with a curved lower portion to orient the foot members at the lower ends of the vertical frame members outside of the corresponding upper ends of the vertical frame members.

It is still a further feature of this invention that the footprint of the lower frame members of the play yard is larger than the footprint of the upper play yard frame members.

It is still another advantage of this invention that the curved lower portions of the vertical frame members of the play yard allow the mounting of the changing table on the upper ends of the vertical frame members along the transverse centerline of the changing table.

It is still another object of this invention to provide a height adjustment mechanism for a play yard mounted changing table that is housed within the frame of the play yard.

It is yet a further feature of this invention that the upper portions of the vertical frame members of the play yard are formed linearly to accommodate vertical height adjustment of the changing table relative to the play yard frame.

It is a further object of this invention to provide a changing table structure for mounting on a play yard frame that is durable in construction, inexpensive to manufacture, carefree of maintenance, facile in assemblage, and simple and effective in use.

These and other objects, features and advantages are accomplished according to the instant invention by providing a changing table that is mounted on the vertical frame members of a play yard by mounting members located along the transverse centerline of the changing table. The frame of the changing table is formed in an oval shape to eliminate any portion thereof that would be oriented generally parallel to the upper frame members of the play yard. The vertical frame member is formed with a linear upper portion and a curved lower portion. The linear upper portions enable the mounting members to be telescopically received for height adjustment of the changing table. The curved lower portions positions the foot members at the lower ends of the vertical frame members outboard of the upper ends on which the changing table is mounted to enhance stability.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
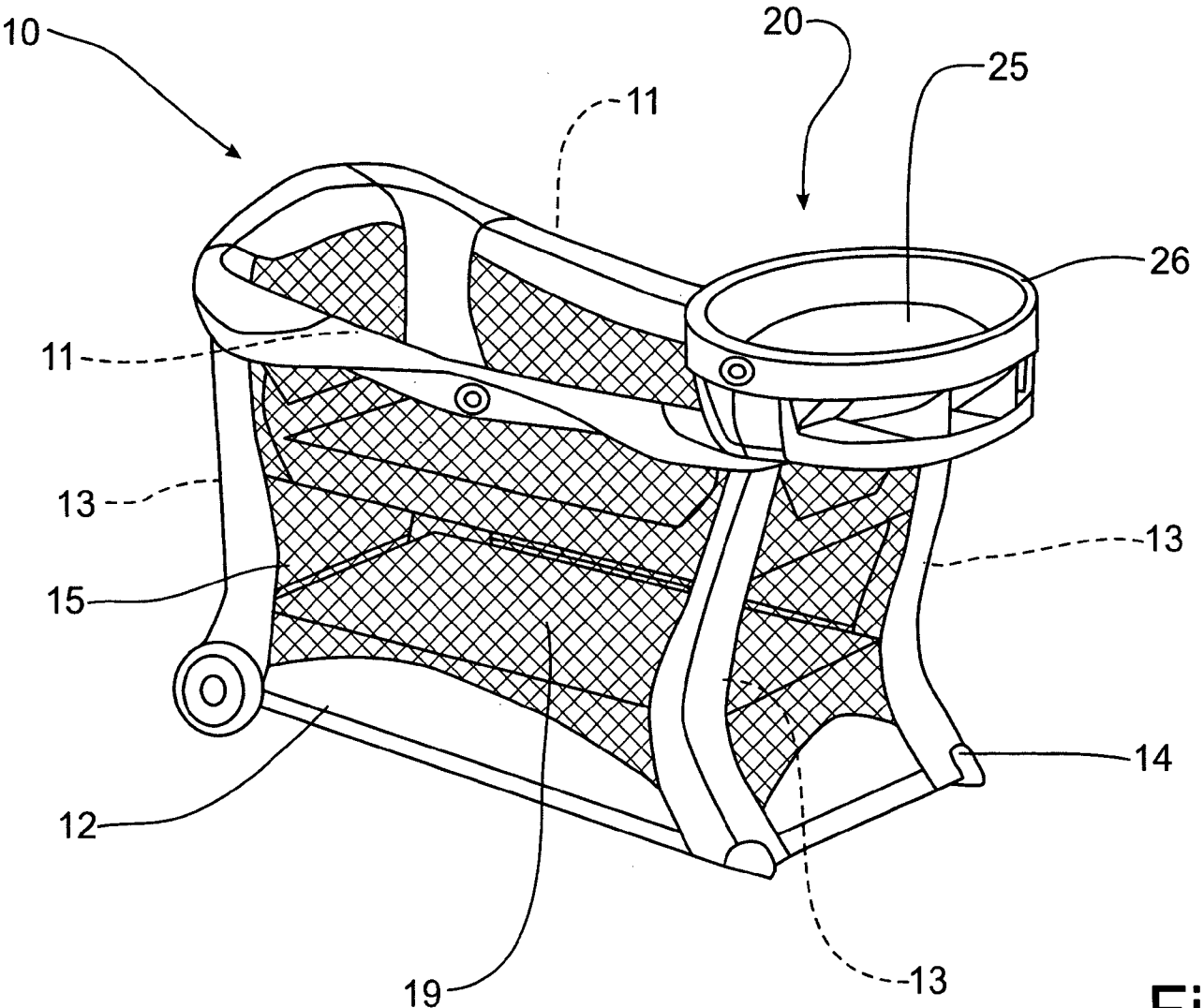
FIG. 1 is a perspective schematic view of a play yard having a changing table incorporating the principles of the instant invention mounted thereon.

Referring now to FIGS. 1-4, a child play yard incorporating the principles of the instant invention can best be seen. As best seen in FIG. 1, the play yard 10 incorporates a frame structure that is covered by the fabric body 15. The frame structure includes upper frame members 11 defining a generally rectangular shape around the top of the play yard 10 establishing an upper boundary thereof, lower frame members 12 positioned below the upper frame members 11 and providing a generally rectangular support for the floor member 19 of the play yard 10, and vertical frame members 13 interconnecting the upper and lower frame members 11, 12 and defining the corners of the play yard 10. The vertical frame members 13 terminate in respective foot members 14 that are attached to the vertical frame members 13 to engage the floor support surface on which the play yard is disposed.

While the preferred embodiment of the play yard 10 defines the upper boundary of the play yard by the upper frame member 11 supported by vertically extending frame members 13 which extend upwardly from the lower frame members 12, one skilled in the art will recognize that the frame configuration of the play yard 10 could be substantially different. For example, the upper boundary of the play yard 10 could be formed from the soft goods, i.e. fabric that is stretched taut between vertically extending frame members or posts. The frame configuration of the play yard 10 might not have vertical frame members or posts that form the corners of the play yard 10. The vertical frame members could be oriented diagonally along the sides of the play yard 10 with the soft goods defining the vertical corners of the play yard 10 extending between upper and lower frame members. One skilled in the art will recognize that in all play yard configurations, the play yard 10 will have an upper boundary, a bottom and sides extending between the upper boundary and the bottom supported by a frame structure.

The fabric body 15 forms an enclosure around the periphery of the play yard 10. The fabric body 15 is preferably formed with an upper tunnel through which the upper frame members 11 are placed to support the upper portion of the fabric body. The fabric body 15 is then drawn taut forming vertical corners around the vertical frame members 13. The fabric body 15 is also drawn taut over the lower frame members 12 and secured, as will be described in greater detail below. The fabric body 15 preferably includes generally vertical mesh portions 16 to facilitate viewing a child positioned on the play yard floor 19.

A changing table 20 can be mounted on the top of the play yard 10 to provide a support surface for placing an infant at the convenient access of the caregiver so that the caregiver can easily change the infant's clothes. The changing table 20 has a base member 22 having mounting members 23 that are telescopically received within the corresponding vertical frame members 13 of the play yard 10, as will be described in greater detail below, to support the changing table 20 on top of the play yard 10. The base member 22 supports a table 25 having a table frame member 26 extending around the circumference of the table 25.

Figure 2:
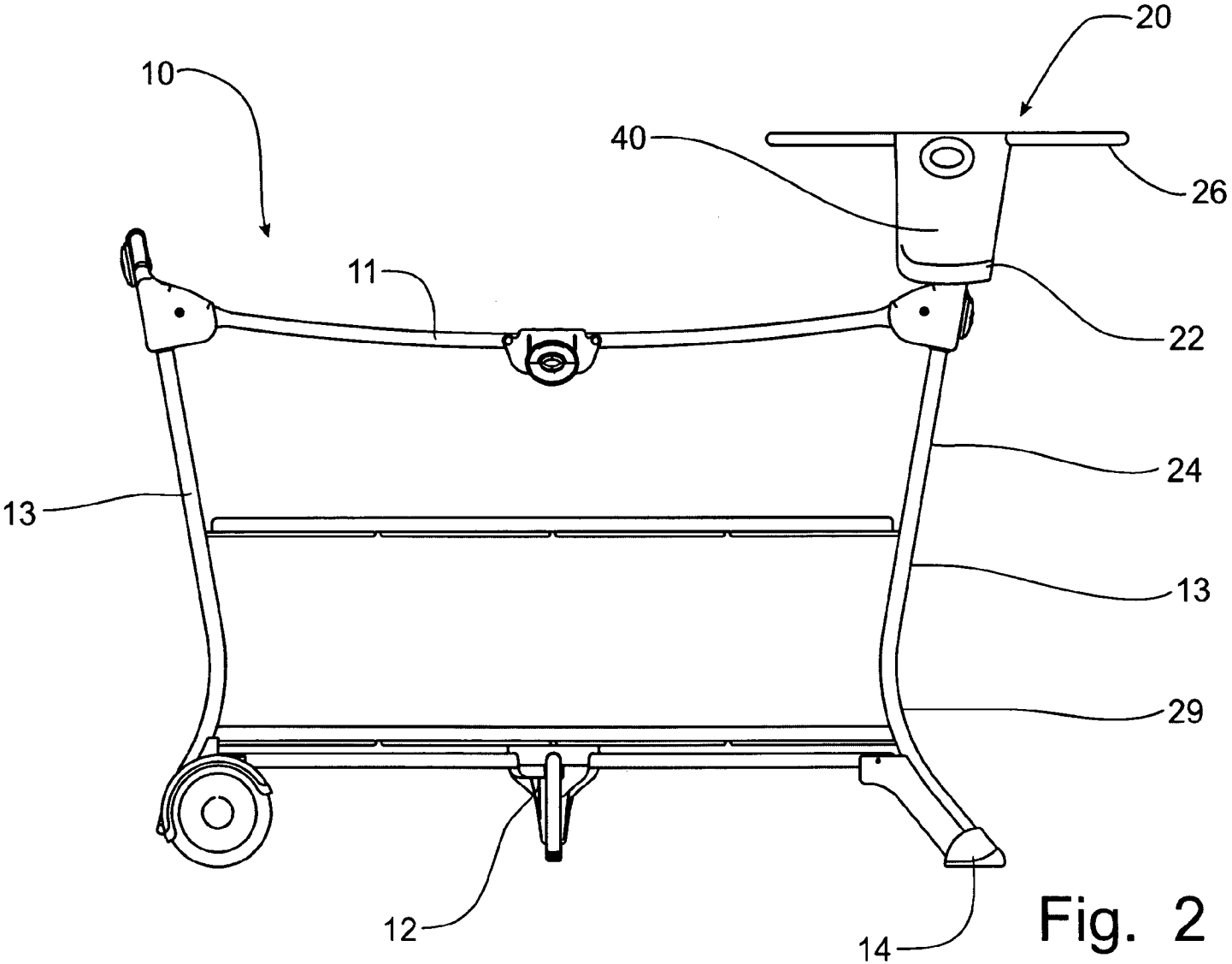
FIG. 2 is a schematic side elevational view of the play yard and changing table shown in FIG. 1 with the changing table being oriented in a raised operative position, the soft goods for the changing table being deleted for purposes of clarity.
Figure 3:
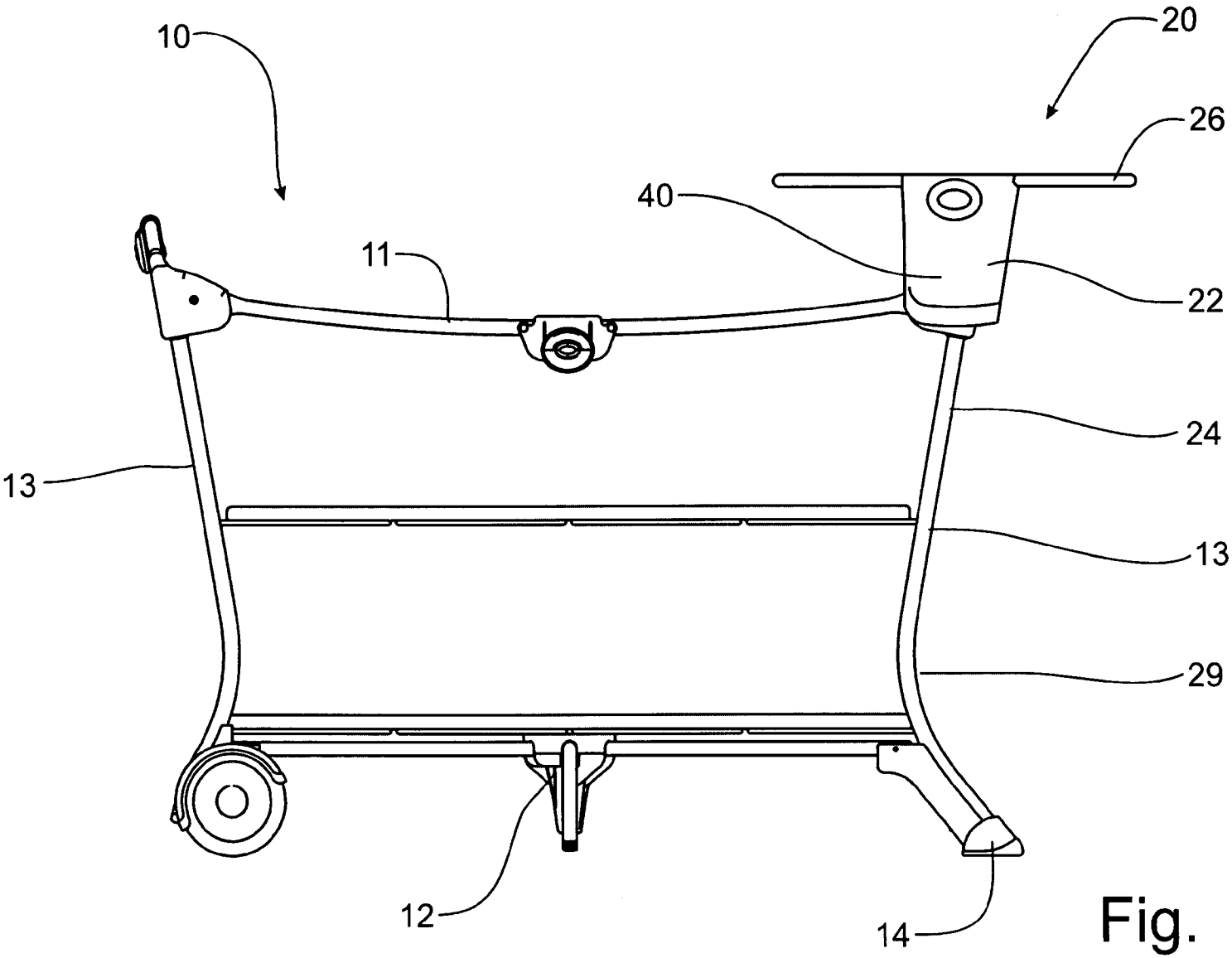
FIG. 3 is a schematic side elevational view of the play yard and changing table as depicted in FIG. 2, but with the changing table moved to a lowermost operative position.
Figure 6:
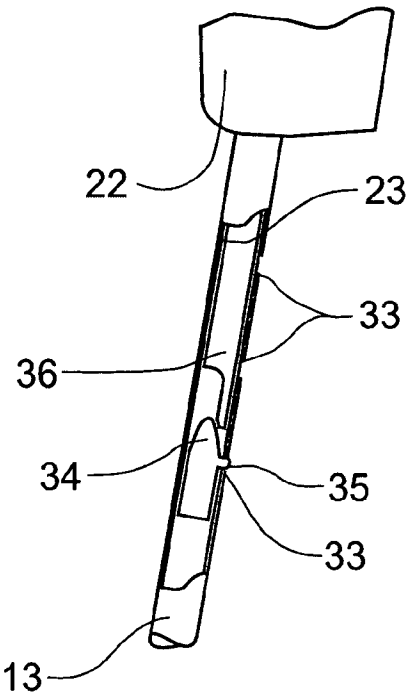
FIG. 6 is an enlarged detail view of the actuator for the lock tab of the changing table height adjustment mechanism, the lock tab being in a locked position.
Figure 7:
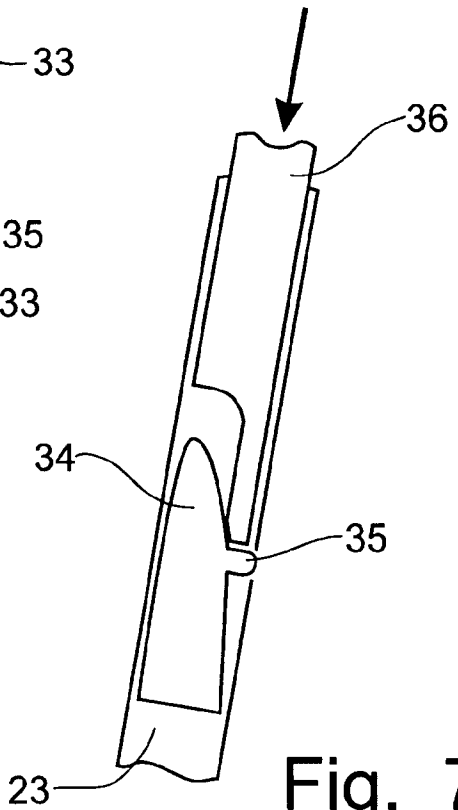
FIG. 7 is an enlarged detail view of the engagement of the actuator to move the lock tab to a release position and permit a vertical movement of the changing table relative to the play yard frame.

The changing table 20 is supported to be positionally adjustable in a generally vertical direction to locate the table 25 along a range of vertical heights from the uppermost, raised operative position shown in FIG. 2 to the lowermost operative position shown in FIG. 3, with the number of intermediate height adjusted positions being a matter of choice. As can be seen in FIGS. 6 and 7, the vertical mounting members 23 are formed with a locking apparatus 30 that engages openings 33 formed in the vertical frame members 13 to lock the vertical mounting members 23 into a selected position and secure the vertical height of the changing table 20. The locking mechanism 30 can be formed with a locking button 35 that is configured to project through the selected opening 33 in the vertical frame member 13, the locking button 35 being formed as part of a leaf spring 34 positioned within the vertical mounting member 23.

An actuator 36 is operated from a spring-biased push button (not shown) accessible at a convenient location at the top of the base member 22 to depress the actuator 36 into engagement with the spring 34. As seen in a comparison between FIGS. 11 and 12, the actuator 36 moves along the sloped surface of the spring 34 to cam the spring 34 into the interior of the vertical mounting member 23 and retract the locking button 35 into the vertical mounting member 23 out of engagement with the vertical frame member 13. The changing table 20 can then be relocated at a desired height and the actuator 36 released to allow the spring 34 to urge the locking button 35 toward and through an aligned opening 33 corresponding to the selected height of the changing table 20.

Figure 5:
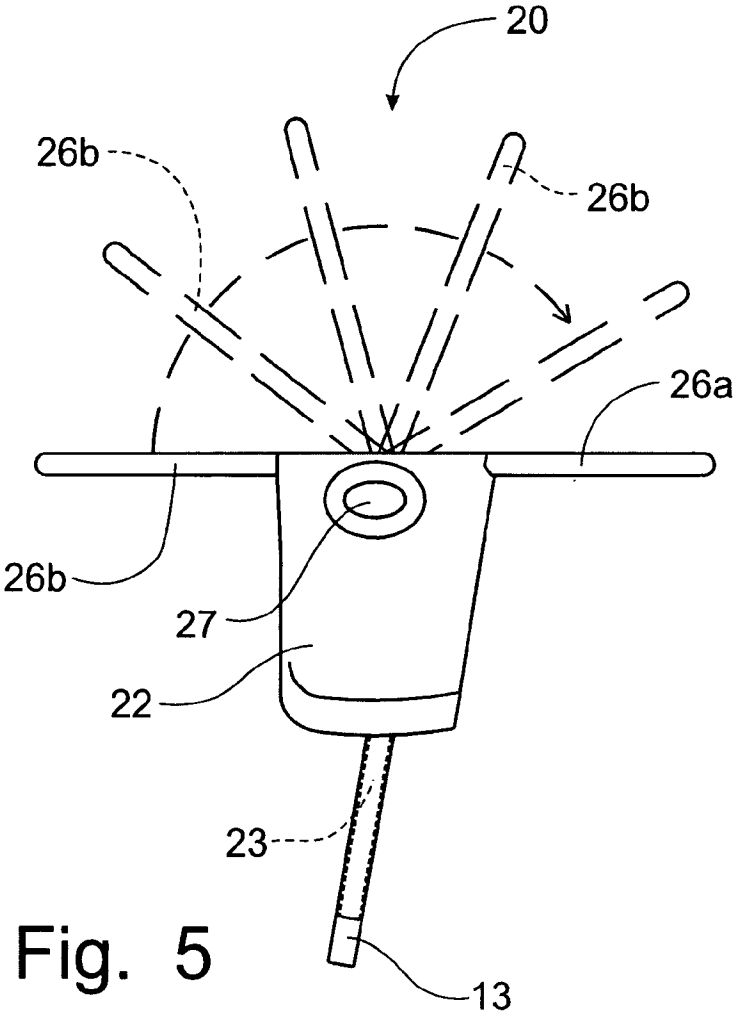
FIG. 5 is an enlarged partial elevational view of the changing table frame mounted into the vertical frame member of the play yard, the upper linear portion of the vertical frame member being shown, the mounting member of the changing table being shown in dashed lines and the folded orientation of the changing table frame being shown in phantom.

The changing table 20 is formed with an oval-shaped frame 26 that encircles the table 25, centered over the base portion 22. The oval shape of the table frame 26 provides a frame structure that minimizes the portion of the table frame 26 that would be parallel to the upper frame member 11 of the play yard 10 to limit the creation of any head entrapment opening between the table frame 26 and the upper frame 11. Accordingly, a generally oval shape to the table frame 26 would also be effective in limiting the creation of a head entrapment opening. The frame 26 includes a pair of generally vertically extending mounting members 23 that are substantially aligned with the transversely extending centerline 27 of the changing table 20, as can be seen schematically in FIG. 5, which are received in the upper portions 24 of the frame members 13.

Figure 4:
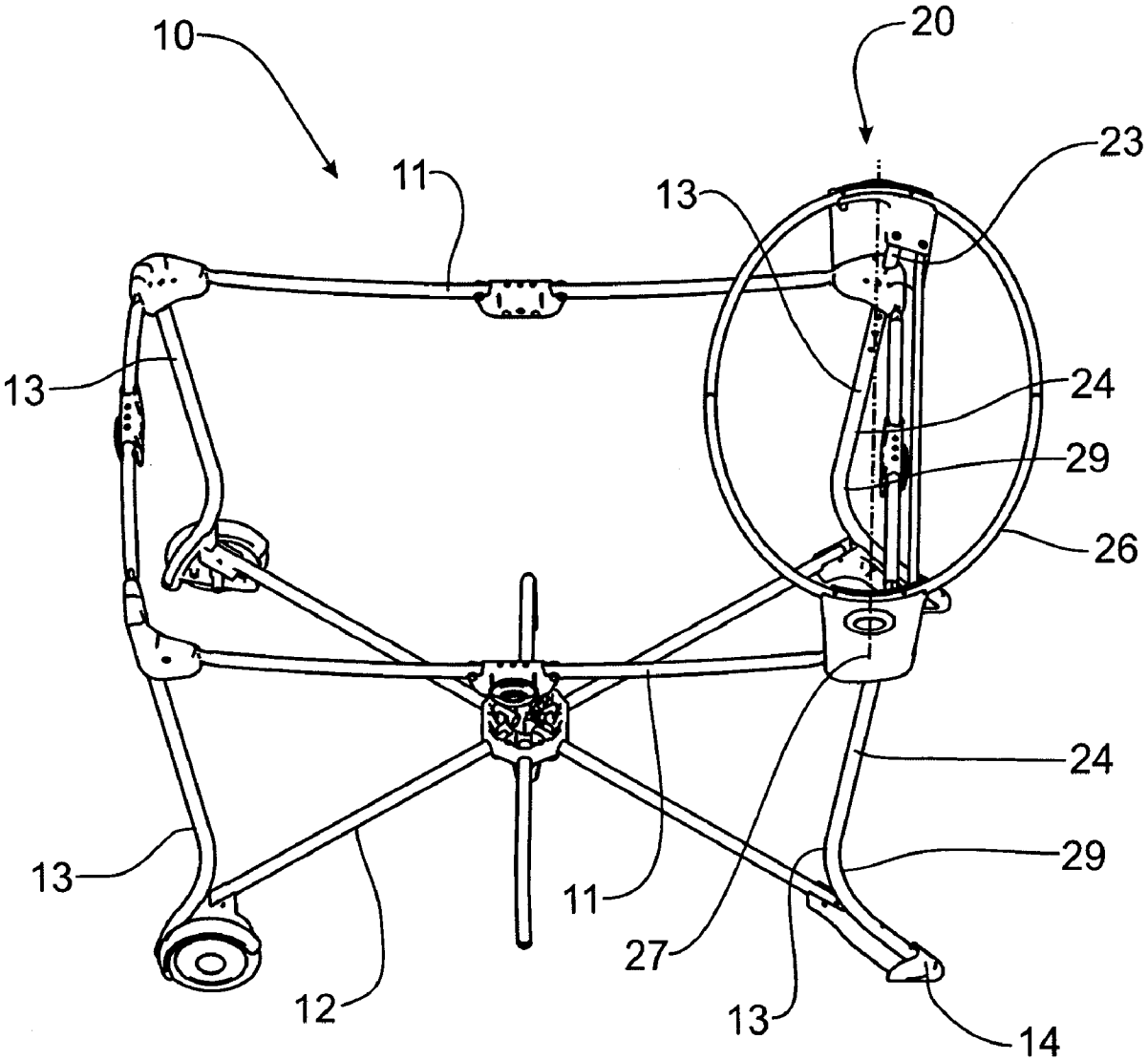
FIG. 4 is a top perspective view of the frames of the play yard and changing table to show the orientation of the changing table frame relative to the frame of the play yard.

As best seen in FIG. 4, the centerline 27 of the table frame 26 is slightly offset from the upper ends of the vertical frame members 13, corresponding to the configuration of the base member 22. This mounting arrangement of the changing table 20 places the center of gravity of the changing table 20 substantially directly over the vertical frame members 13, which can lead to an instability for both the changing table 20 and the play yard 10. To keep the center of gravity of the changing table 20 inside the frame structure of the play yard 10, the vertical frame members 13 of the play yard 10 are formed with a linear upper portion 24 and an outwardly curved lower portion 29.

The outward sweep of the curved lower portions 29 place the lower ends of the frame members 13, where the foot members 14 are located, outwardly of the upper ends of the frame members 13 so that the center of gravity of the changing table 20 is inward of the lower frame members 12 and the overall stance of the play yard 10. For aesthetic purposes, the shape of the vertical frame members 13 at opposing ends of the play yard 10 can be formed with a curved configuration with the frame members 13 supporting the changing table 20 orienting the linearly extending upper portions 24 at an angle to horizontal, as can be seen in FIGS. 1-3. Accordingly, the height adjustment of the changing table 20 will not be perfectly vertical, but at a slight angle to vertical as defined by the inclination of the upper portions 24.

As is best seen in FIG. 4, the oval shape of the changing table frame 26 is configured to diverge from the upper frame members 11 immediately after exiting the base member 22. With this oval shape, the frame 26 of the changing table 20 has very little portion thereof that is oriented parallel to the upper frame members 11 of the play yard and the gap between the changing table frame 26 and the upper play yard frame 11 constantly increases as the oval-shaped frame 26 extends inwardly toward the center of the changing table 20. To block the minimal gap between the table frame 26 and the upper frame 11, the base member 22 is preferably formed with a vertical guard member 40. As can be seen in FIGS. 2 and 3, the height adjustment movement of the changing table 20 projects directly from the upper ends of the frame members 13. By completely lifting the mounting members 23 from the frame members 13, the changing table 20 can be removed easily from the play yard 10.

In the alternative, the oval changing table frame 26 can be bifurcated at the ends of the transversely extending centerline 27 to divide the oval changing table frame 26 into a fixed half **26*a* and a movable half 26*b*. The movable half 26*b* of the oval table frame 26 overhangs the floor 19 of the play yard 10 inside of the frame members 13. The movable half 26*a* is pivotally mounted to the base member 22 so that the movable half 26*a* can be pivoted about the transversely extending axis 27 to place the changing table 25 into an inoperative orientation, as is reflected in FIG. 5, with both the fixed half 26*a* and the movable half 26*a* of the oval frame 26 being located on the outside of the transverse centerline 27**.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A play yard comprising:

a frame structure including an upper boundary member, a bottom member and sides extending between said upper boundary member and said bottom member, said frame structure further including two post members extending between said upper boundary member and said bottom member, each said post member being formed with a linear upper portion;

a changing table providing an infant support surface on which an infant can be placed, said infant support surface having a movable half and a fixed half with said fixed half extending outboard of said upper boundary member such that the infant can be supported on said fixed half of said changing table outboard of said upper boundary member, said changing table being mounted on said frame structure and being vertically positionally adjustable relative to said upper boundary member between an uppermost operative position and a lowermost operative position, said changing table supporting storage compartments under said infant support surface; and said changing table being movable between an opened operative position and a folded inoperative position and including a table frame member supporting said movable and fixed halves of said infant support surface and being vertically movable with said changing table, said table frame member including mounting members received within corresponding said post members to be vertically movable therefrom for the vertical adjustable positioning of said changing table relative to said upper boundary member, said mounting members being oriented substantially along a transversely extending centerline of said infant support surface when said changing table is in said opened operative position, said table frame member folding about said centerline when moving into said folded inoperative position so that said movable half of said infant support surface overlies said fixed half and extends outboard of said upper boundary member and completely outboard of said bottom member, said infant support surface being substantially centered over the linear upper portion of said post members when in said opened operative position.

2. The play yard of claim 1 wherein said post members are also formed with curved lower portions that are oriented to locate lower ends of said two post members outwardly of corresponding upper ends of said post members receiving said mounting members.

3. The play yard of claim 1 wherein said table frame member has a generally oval shape.

4. The play yard of claim 3 further comprising a locking mechanism associated with each said mounting member to secure said changing table at a selected height relative to said play yard frame structure.

5. In a combination of a play yard and a changing table mounted on said play yard to provide an elevated infant support, the play yard having a frame structure including an upper boundary member and post members, said changing table having a table frame member with generally vertically extending support members engagable with said post members, the improvement comprising:

said table frame member is formed with a curved frame section defining an oval shape for an infant support surface that is substantially centered over said support members, said table frame member defining a movable half of said infant support surface that is pivotally connected along a transverse centerline over said support members to a fixed half of infant support surface extending outboard of said upper boundary member such that the infant can be supported on said fixed half of said changing table outboard of said upper boundary member, said changing table supporting storage compartments under said infant support surface, said curved frame section including a movable portion corresponding to said movable half of said infant support surface extending from said support members and overlying said play yard, said movable portion diverging forwardly and inwardly relative to the upper boundary member such that said table frame member is free of a longitudinally extending portion oriented parallel to said upper boundary member of said play yard frame structure, said movable portion of said table frame member folding about said transverse centerline when moving from an opened operative position into a folded inoperative position so that said movable half of said infant support surface is folded over said fixed half of said infant support surface and extends outboard of said upper boundary member, said infant support surface being substantially centered over the post members; and each of said post members of said play yard frame structure being formed with an upper linear portion supporting, respectively, said support members of said table frame member, said upper linear portions extending inwardly and downwardly from said table frame member to a curved lower portion that curves outwardly to locate lower ends of said post members outwardly of said upper ends supporting said table frame member such that said changing table is substantially inwardly of said lower ends with said fixed half of said table frame member being located outwardly of said linear portion of said post members.

6. The combination of claim 5 wherein said generally oval-shaped table frame member includes a guard member at transverse ends of said table frame member to block a gap between said transverse end of said table frame and said upper boundary member of said play yard.

7. The combination of claim 5 wherein said changing table has a base member including a pair of downwardly extending mounting members supported for generally vertical movement with respect to corresponding said post members.

8. The combination of claim 7 wherein said mounting members are oriented substantially along a transversely extending centerline of said changing table.

9. The combination of claim 5 wherein said generally oval-shaped table frame member is bifurcated along a transversely extending centerline of said changing table to divide said table frame member into a fixed portion and a movable portion, said movable portion being pivotable about a pivot axis corresponding to said transversely extending centerline.

10. A changing table mountable on a play yard to provide an elevated infant support surface for supporting a child, said play yard having an upper boundary member and post members interconnecting said upper boundary member and a bottom member, comprising:

a base member supported on said post members; and a table frame member movable between an opened operative position and a folded inoperative position, said table frame member supporting an infant support surface and being supported on said base member such that said infant support surface is substantially centered on said base member when said table frame member is in said opened operative position, said table frame member being bifurcated along a transversely extending centerline of said changing table to divide said table frame member into a fixed portion extending outboard of said upper boundary member such that the child can be supported on said fixed half of said changing table outboard of said upper boundary member and a movable portion extending inboard of said upper boundary member and being pivotally connected to said fixed portion about a pivot axis corresponding to said transversely extending centerline so that a movable inner half of said infant support surface can be folded over a fixed outer half of said infant support surface when in said folded inoperative position, whereby said table frame member is located outboard of said bottom member when in said opened operative position and whereby said infant support surface is substantially centered over the post members when said table frame member is in a closed inoperative position with said movable portion overlying said fixed portion, said base member being located along said centerline such that said base member is located along a side of said table frame member when placed into said folded inoperative position, said changing table supporting storage compartments under said infant support surface.

11. The changing table of claim 10 wherein said table frame member has a substantially oval shape.

12. The changing table of claim 11 wherein said base member is formed with mounting members that are substantially aligned with said transversely extending centerline of said changing table corresponding to a major axis of said oval-shaped table frame member, said mounting members being telescopically received within said post members so that said base member is vertically movable between an uppermost operative position and a lowermost operative position.

13. The changing table of claim 12 wherein each said corresponding post member is formed with a linear upper portion terminating in an upper end receiving said mounting members, each said post member further including a curved lower portion terminating in a lower end.

14. The changing table of claim 13 wherein said curved portion locates said lower end outwardly from said upper end such that said changing table is substantially inwardly of said lower ends.

15. The changing table of claim 14 wherein said generally oval-shaped table frame member includes a guard member at transverse ends of said table frame member to block a gap between said transverse end of said table frame and said upper boundary member of said play yard.

* * * * *